US011571896B2

(12) United States Patent
Marra, III et al.

(10) Patent No.: US 11,571,896 B2
(45) Date of Patent: Feb. 7, 2023

(54) CUSTOMIZATION OF MULTICHANNEL PRINTHEAD

(71) Applicant: Funai Electric Co., Ltd., Osaka (JP)

(72) Inventors: Michael A. Marra, III, Lexington, KY (US); Sean T. Weaver, Florence, KY (US)

(73) Assignee: Funai Electric Co., Ltd.

( * ) Notice: Subject to any disclaimer, the term of this patent is extended or adjusted under 35 U.S.C. 154(b) by 171 days.

(21) Appl. No.: 17/248,642

(22) Filed: Feb. 1, 2021

(65) Prior Publication Data

US 2022/0242124 A1 Aug. 4, 2022

(51) Int. Cl.
*B41J 2/16* (2006.01)
*B41J 2/14* (2006.01)

(52) U.S. Cl.
CPC ..... *B41J 2/1632* (2013.01); *B41J 2/14016* (2013.01)

(58) Field of Classification Search
CPC .. B41J 2/1632; B41J 2/14016; B41J 2202/17; B41J 2/14024; B41J 2/14072; B41J 2/14145; B41J 2/14088
See application file for complete search history.

(56) References Cited

U.S. PATENT DOCUMENTS 5,555,006 A 9/1996 Cleveland et al.
5,900,892 A 5/1999 Mantell et al.
6,267,468 B1 7/2001 Torgerson et al.
6,511,160 B1 1/2003 Morita et al.
6,746,105 B2 6/2004 Silverbrook
6,754,551 B1 6/2004 Zohar et al.
2002/0149632 A1* 10/2002 Parish ..... B41J 2/1601 347/5
2007/0159513 A1 7/2007 Hibi

OTHER PUBLICATIONS

IP.com search (Year: 2022).*

* cited by examiner

*Primary Examiner* — Lisa Solomon
(74) *Attorney, Agent, or Firm* — Luedeka Neely Group, PC

(57) ABSTRACT

A method of forming a print head, by forming a heater chip. Via zones having peripheries are defined on a substrate, with heaters formed along the entire peripheries of the via zones. Traces that electrically connect to each of the heaters are formed. In some embodiments, the heater chip is then stored for a period of time. After storing the heater chip, vias are formed in only a selected portion of the via zones, which is a subset of the via zones. A channel layer is formed on the heater chip by forming a first layer on the heater chip. Flow channels are formed in the first layer from the vias to only those heaters on the heater chip that are disposed along the selected portion of the via zones. Bubble chambers are formed in the first layer around only those heaters on the heater chip that are disposed along the selected portion of the via zones. A nozzle plate in formed on the channel layer by forming a second layer on the first layer, and forming nozzles in the second layer above only those heaters on the heater chip that are disposed along the selected portion of the via zones.

20 Claims, 9 Drawing Sheets

CUSTOMIZATION OF MULTICHANNEL PRINTHEAD

FIELD

This invention relates to the field of inkjet printheads. More particularly, this invention relates to a configurable inkjet printhead that is adaptable to several different reservoir configurations.

INTRODUCTION

Thermal inkjet technology uses, among other things, an inkjet cartridge that in its basic form is comprised of a reservoir and a print head. The reservoir holds the fluid to be expelled by the cartridge, which can be ink, but can also be other fluids. A given cartridge might have only a single reservoir with a single fluid to be ejected. However, another cartridge might have six reservoirs containing six different fluids to be ejected.

The print head is in fluid communication with the reservoir, and comprises, in some embodiments, three main layers. The first layer is an electronics layer, sometimes formed in silicon, and often referred to as a CMOS heater chip. The chip receives the fluid from the reservoirs on one side of the chip, and passes the fluid through vias formed in the chip to heaters that are formed on the other side of the chip.

The fluid is conducted from the vias to the heaters by the second layer of the print head, which is the flow channel layer. The channel layer forms fluidic channels or pathways from the vias in the chip to bubble chambers that are formed in the flow layer around the heaters on the chip. The third main layer of the print head is the nozzle layer, which includes nozzle holes that are formed above the bubble chambers, and through which the fluid is expelled onto a substrate of some sort (like paper) when the heaters in the chip are energized.

Inkjet technology is used in a wide variety of applications, and thus printer cartridges tend to require a wide variety of configurations and options. For example, some need to expel one fluid, and others need to expel multiple fluids. Further, the configuration of the ports in the reservoirs that conduct the fluids to the heater chip can be different for different applications.

These different configurations of reservoirs tend to require different configurations of print heads. While it is common to vary the thicknesses and geometries of the channel and nozzle layers for a given heater chip, changes that require a different chip can be relatively costly to implement. In addition, some applications require different geometries for the expelled fluids, which traditionally also require a different chip design.

What is needed, therefore, is a print head design that tends to reduce issues such as those described above, at least in part.

SUMMARY

The above and other needs are met by a method of forming a print head, by forming a heater chip. Via zones having peripheries are defined on a substrate, with heaters formed along the entire peripheries of the via zones. Traces that electrically connect to each of the heaters are formed. In some embodiments, the heater chip is then stored for a period of time. After storing the heater chip, vias are formed in only a selected portion of the via zones, which is a subset of the via zones. A channel layer is formed on the heater chip by forming a first layer on the heater chip. Flow channels are formed in the first layer from the vias to only those heaters on the heater chip that are disposed along the selected portion of the via zones. Bubble chambers are formed in the first layer around only those heaters on the heater chip that are disposed along the selected portion of the via zones. A nozzle plate in formed on the channel layer by forming a second layer on the first layer, and forming nozzles in the second layer above only those heaters on the heater chip that are disposed along the selected portion of the via zones.

In this manner, not all of the heaters and traces on the heater chip will be used in the final print head—in other words, some of those heaters and traces will be extraneous and wasted. However, forming all of the heaters and traces wastes no more material than only forming a portion of them due to the photolithographic and deposition processes used, and the convenience and cost savings associated with fabricating the print head to this point with only a single mask set and processing flow are significant. In later processing, this basic heater chip is configured into a print head for a desired specific application.

In various embodiments, the substrate is a silicon substrate. In some embodiments, the heaters and traces are a deposited metal. Some embodiments include a memory circuit formed in the heater chip, the memory circuit containing information in regard to a configuration of the selected portion. In some embodiments, there are three via zones. In some embodiments, there are three via zones and only two of the via zones are the selected portion. In some embodiments, there are three via zones and only end portions of the via zones are the selected portion. In some embodiments, there are three via zones and only end portions of two of the via zones are the selected portion. In some embodiments, there are three via zones and only alternating end portions of the via zones are the selected portion.

DRAWINGS

Further advantages of the invention are apparent by reference to the detailed description when considered in conjunction with the figures, which are not to scale so as to more clearly show the details, wherein like reference numbers indicate like elements throughout the several views, and wherein.

DESCRIPTION

Figure 1:
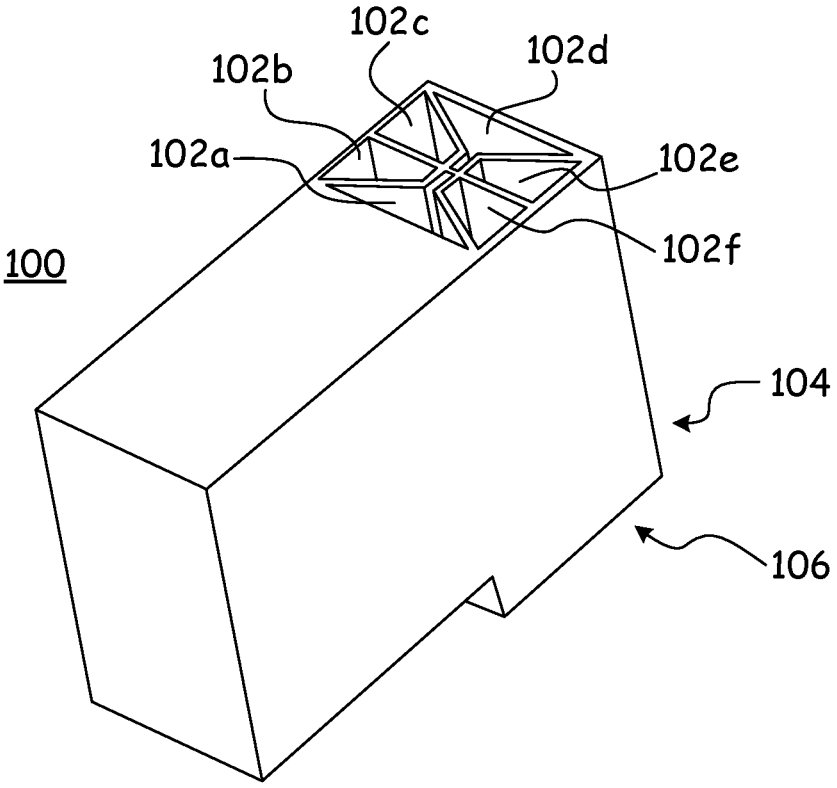
FIG. 1 is a perspective view of an inkjet reservoir according to an embodiment of the present invention.

With reference now to the figures, there is depicted in FIG. 1 a perspective view of an inkjet cartridge 100 according to an embodiment of the present invention. In this embodiment, the cartridge 100 has a reservoir body 104 having six ink reservoirs 102, but it is appreciated that in other embodiments the reservoir body 104 has other numbers of reservoirs 102, and the reservoirs 102 may be differently configured. The print head 200 (not explicitly depicted in FIG. 1) attaches in position 106 is this embodiment, but in other embodiments the print head 200 attaches in other locations, or is even separate from but in fluid communication with the reservoir body 104.

Figure 3:
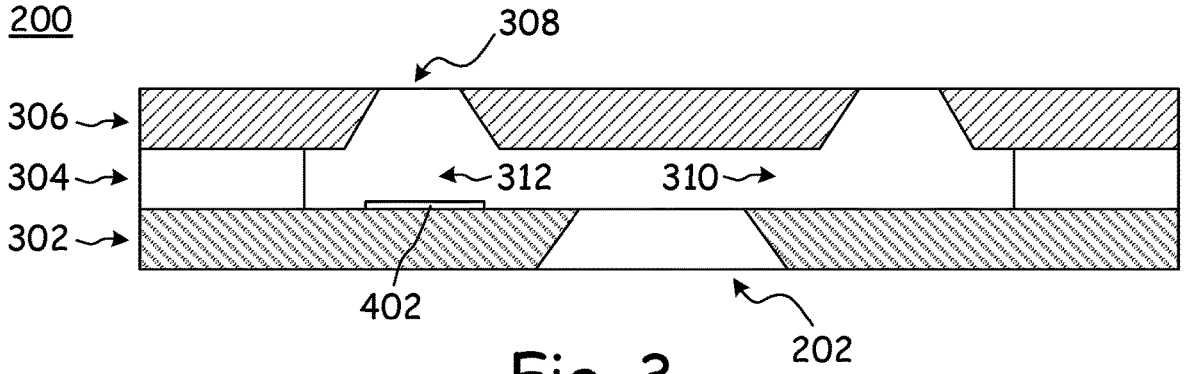
FIG. 3 is a cross-sectional view of a print head according to an embodiment of the present invention.

With reference now to FIG. 3, there is depicted is a cross-sectional view of a print head 200 according to an embodiment of the present invention. In this embodiment, the print head 200 includes three layers, which are the heater chip 302, the flow channel layer 304, and the nozzle plate layer 306. As depicted in FIG. 3, the chip 302 includes a via 202, which is in fluidic communication with a reservoir 102 of the reservoir body 104 (not depicted in FIG. 3). Thus, the via 202 provides the fluid to the other portions of the print head 200. The channel layer 304 includes flow channels 310, which communicate the fluid from the via 202 to a bubble chamber 312 that surrounds a heater 402 in the heat chip 302. The nozzle layer 306 includes nozzles 308 that are disposed above the bubble chambers 312 in the channel layer 304 and the heaters 402 on the chip 302, and through which the fluid is expressed when the heater 402 is energized.

It is appreciated that this description of the print head 200 is quite basic, but more detailed descriptions of the construction methods and materials that are used to fabricate print heads 200 are to be readily had elsewhere.

Figure 4:
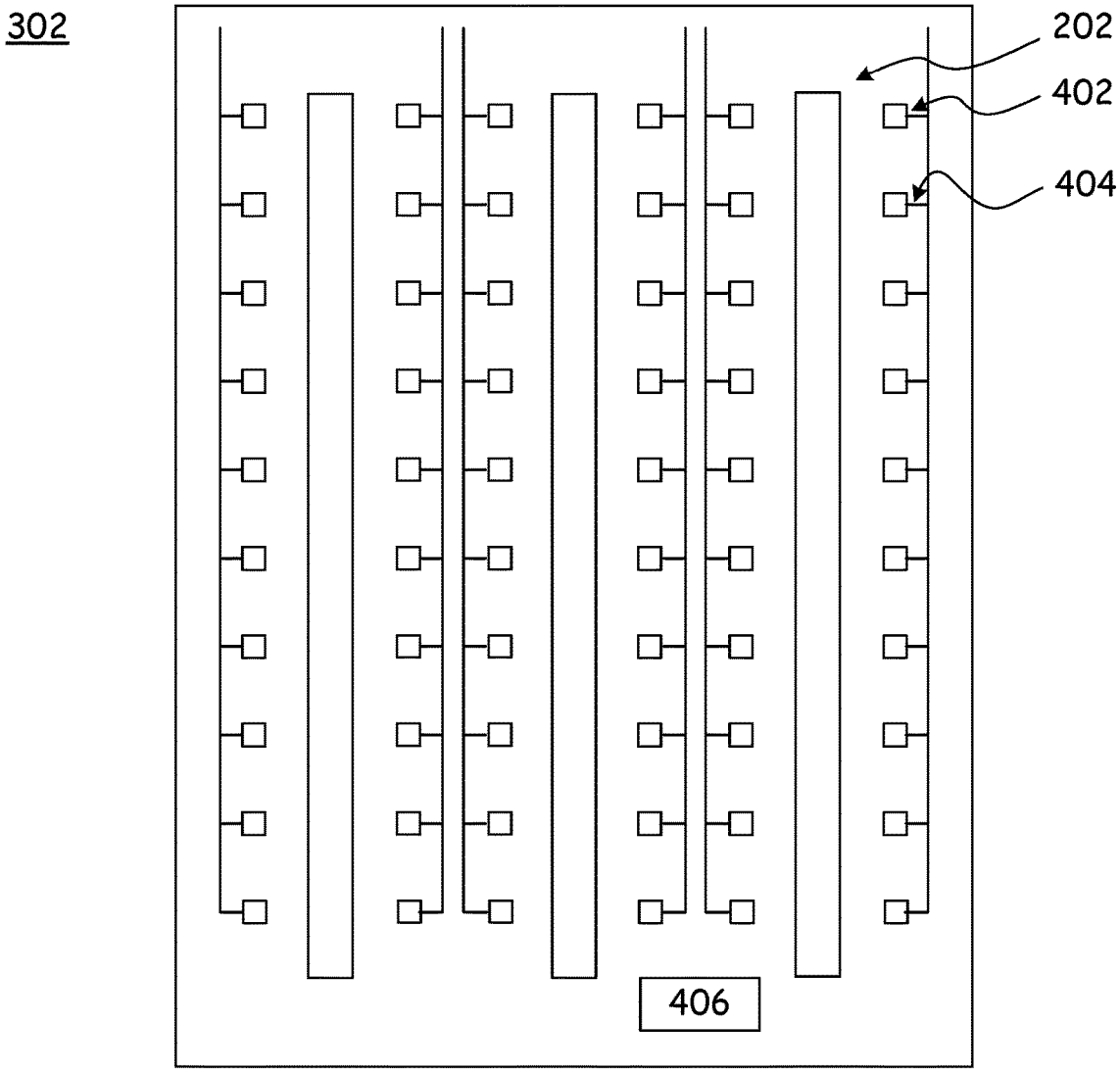
FIG. 4 is a plan view of a heater chip according to an embodiment of the present invention.

With reference now to FIG. 4, there is depicted a plan view of a heater chip 302 according to an embodiment of the present invention, including heaters 402, traces, 404, and vias zones 202. The electrically conductive traces 404 conduct electrical charges to the heaters 402. However, only some of these electrical traces 404 are depicted in FIG. 4, so as to not unnecessarily encumber the figure, and are not depicted at all in the other figures for similar reasons. It is appreciated that the number and position of via zones 202, heaters 402, and traces 404 are only representative in the figures, and that in other embodiments there are different numbers, positions, and arrangements of the via zones 202, the heaters 402, and traces 404.

As explained in more detail hereafter, in each embodiment of the heater chip 302, all of the heaters 402 and all of the traces 404 are formed on the chip 302 around a periphery of all of the via zones 202, regardless of the end configuration of the heater chip 302 that is desired—or in other words, regardless of the configuration of the reservoir body 104 to which the print head 200 will be mated, or the number of reservoirs 102 from which the heater chip 302 will receive fluids. In this manner, the costs associated with designing and fabricating the heater chip 302 through the processes that are used to form the heaters 402 and the traces 404 are reduced, because multiple different designs do not need to be created, fabricated, and inventoried.

However, once the heaters 402 and traces 404 of the heater chip 302 have been formed, the balance of the processing of the chip 302—the formation of the vias within the via zones 202—is customized according to the configuration of the reservoir body 104 and the number and configuration of the ports of the reservoirs 102. However, before this and subsequent steps are performed, the heater chip 302 can be produced and put into inventory for a period of time, so that a sufficient store of the heater chips 302 can be available for later demand. The period of time is variable, according to production needs of the heater chip 302. The benefit is that only a single variation of the heater chip 302 need be produced to this point and inventoried, before stores of these units can be released for further specific processing.

In one embodiment as depicted in FIG. 4, the entirety of the via zones 202 are completely cut to their entire length. In other embodiments, as described more completely below, only a selected portion of the vias zones 202 are cut, or in other words only a subset of the vias zones 202 are cut. This adaptability in the design of the chip 302 enables the chip 302, and the customized layers 304 and 306 that are subsequently formed thereon, to be specifically configured for a desired configuration of a reservoir body 104, which tends to reduce costs as described elsewhere herein.

Figure 5:
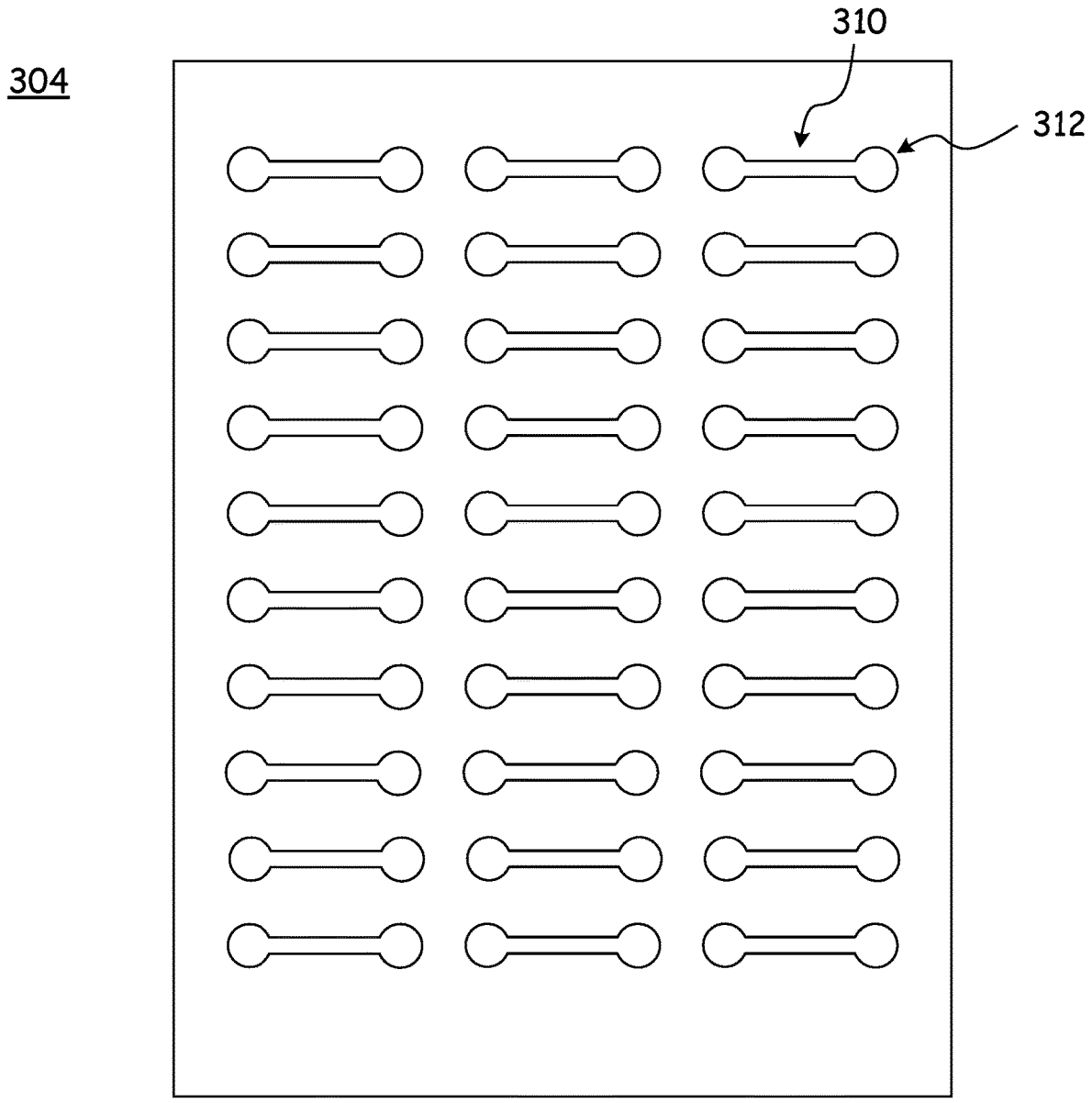
FIG. 5 is a plan view of a channel layer according to an embodiment of the present invention.
Figure 6:
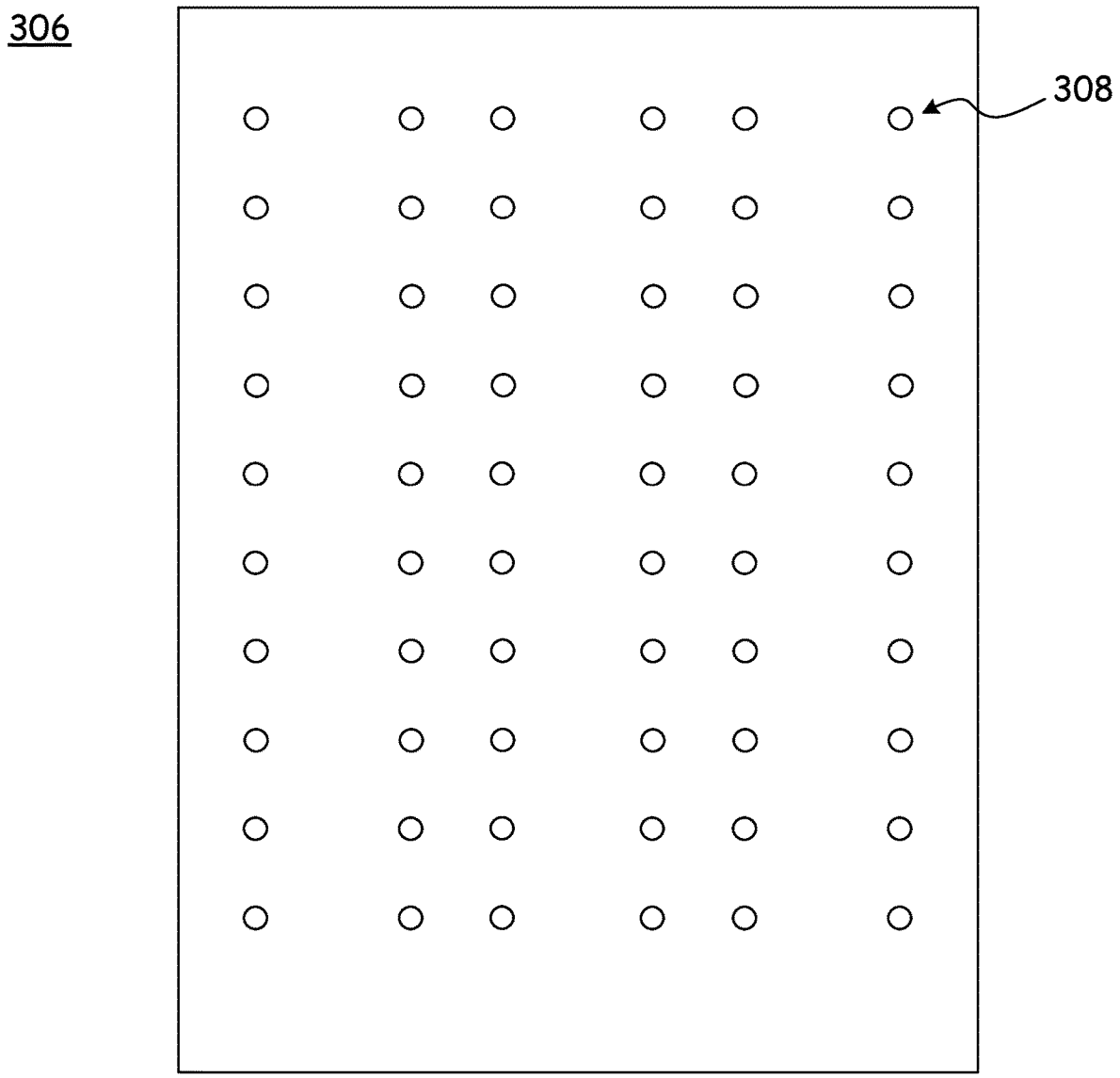
FIG. 6 is a plan view of a nozzle layer according to an embodiment of the present invention.

FIG. 5 depicts a channel layer 304 that is used with the chip 302 of FIG. 4, depicting a full complement of flow channels 310 and bubble chambers 312. FIG. 6 depicts a nozzle plate layer 306 that is used with the chip 302 of FIG. 4, depicting a full complement of nozzles 308. FIGS. 4, 5, and 6 depict what could be called the full utilization of the print head 200 according to the present invention.

Figure 2:
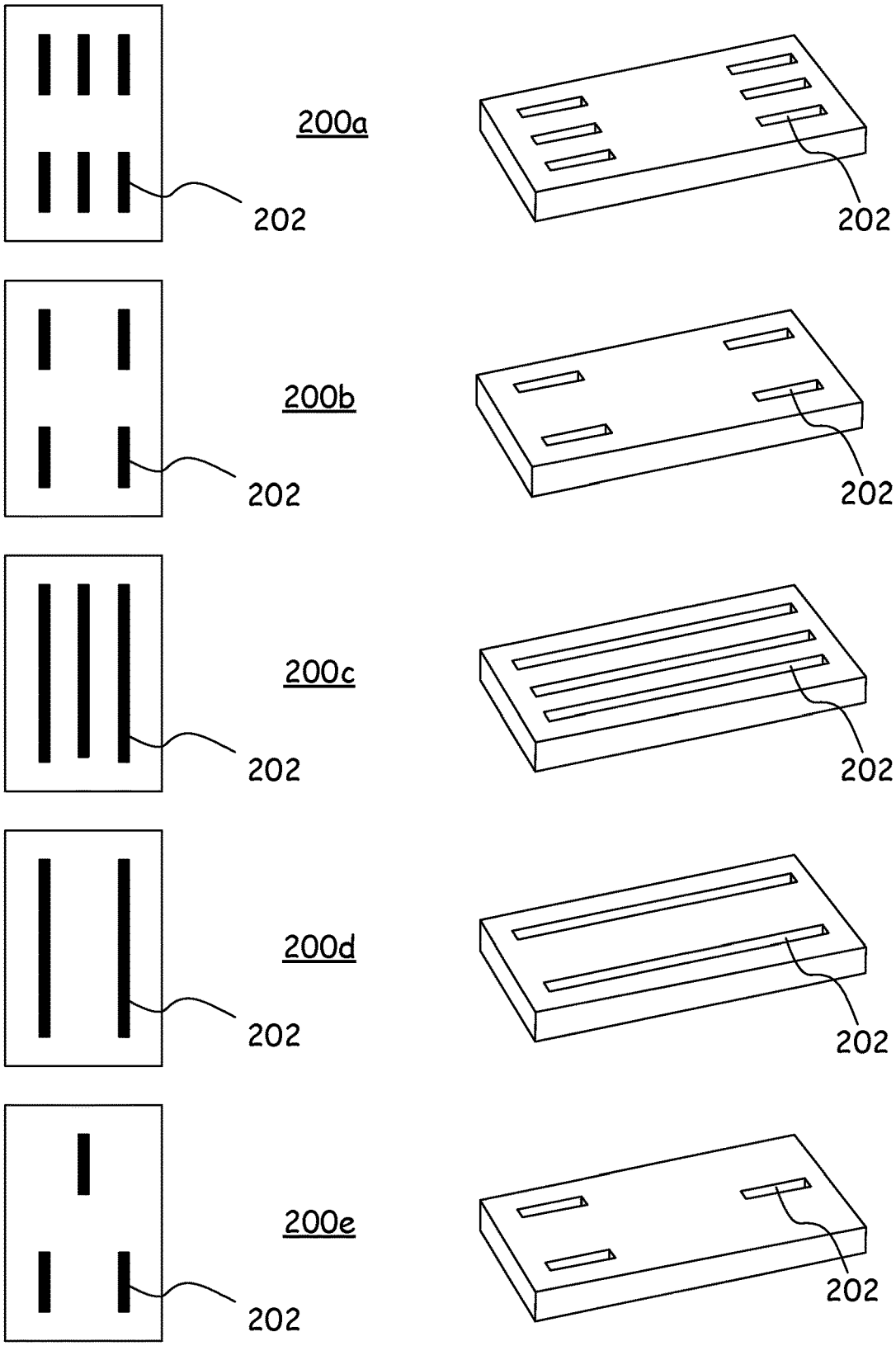
FIG. 2 is plan and perspective views of inkjet print heads according to embodiments of the present invention.

FIG. 2 depicts plan and perspective views of inkjet print heads 200 according to various embodiments of the present invention, from the bottom of the chip 302. Print head 200*c* is the embodiment as depicted in FIGS. 4, 5, and 6, where all of the via zones 202 have been completely cut, and the channel layer 304 and the nozzle layer 306 have also been completely formed. Print head 200*d* corresponds to the embodiment as described in more detail in FIG. 7, print head 200*b* corresponds to the embodiment as described in more detail in FIG. 8, print head 200*a* corresponds to the embodiment as described in more detail in FIG. 9, print head 200*e* corresponds to the embodiment as described in more detail in FIG. 10.

Figure 7:
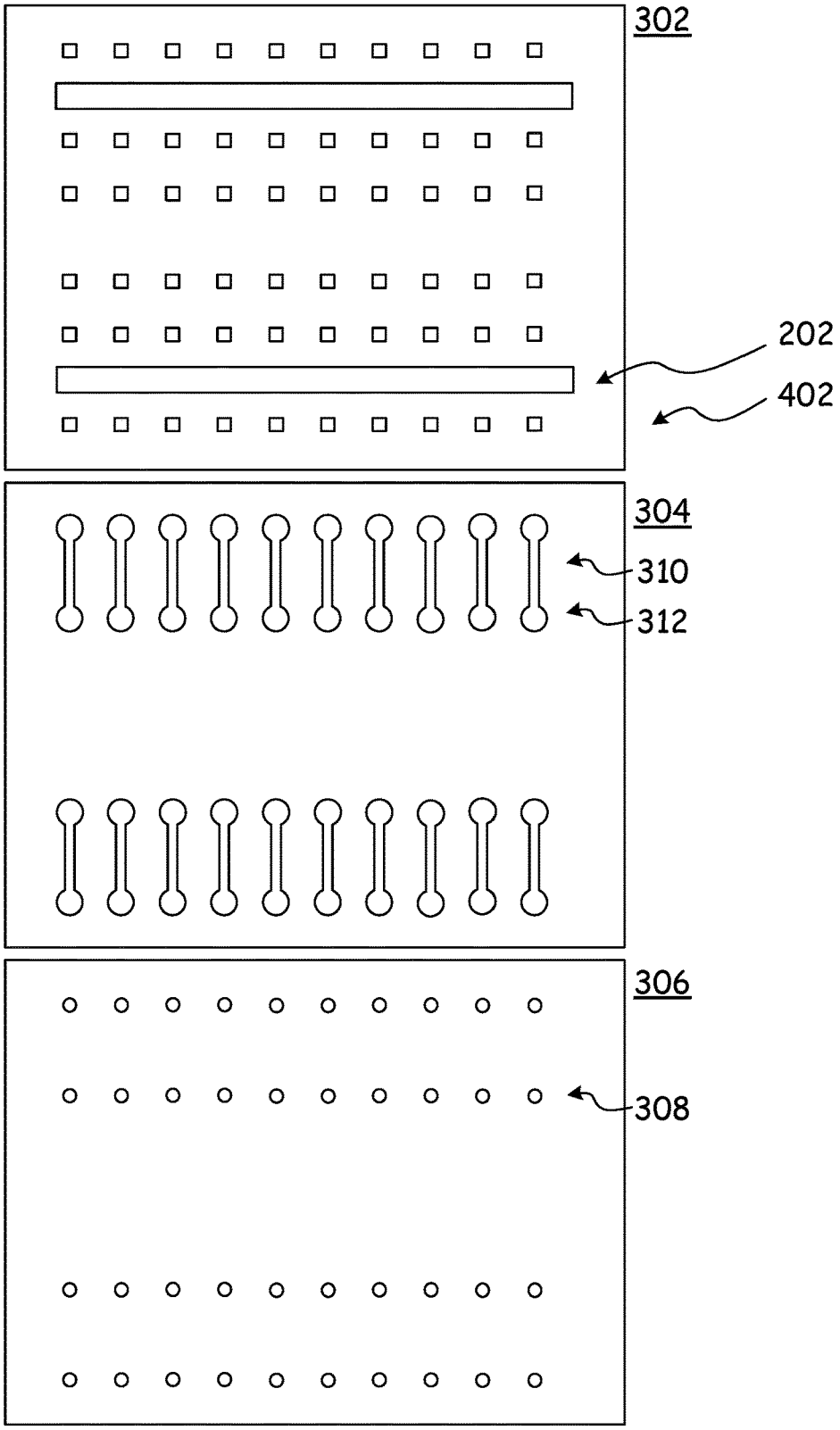
FIG. 7 is plan views of a modified chip, channel layer, and nozzle layer according to a first embodiment of the present invention.

With reference now to FIG. 7, there are depicted plan views of the heater chip 302, channel layer 304, and nozzle plate 306 according to another embodiment of the present invention, where only a subset of the via zones 202 have been cut—the two outside channels 202, but all of the heaters 402 (and traces 404, not depicted) have been formed through prior processing. Similarly, only the flow channels 310 and bubble chambers 312 in the channel layer 304 that correspond to the formed vias 202 in the heater chip 302 have been formed, and only the nozzles 308 in the nozzle plate 306 that correspond to the formed vias 202 in the heater chip 302 have been formed. This embodiment corresponds to 200*d* in FIG. 2, and can be used when the reservoirs 102 have two outlets (perhaps matching two reservoirs 102).

Figure 8:
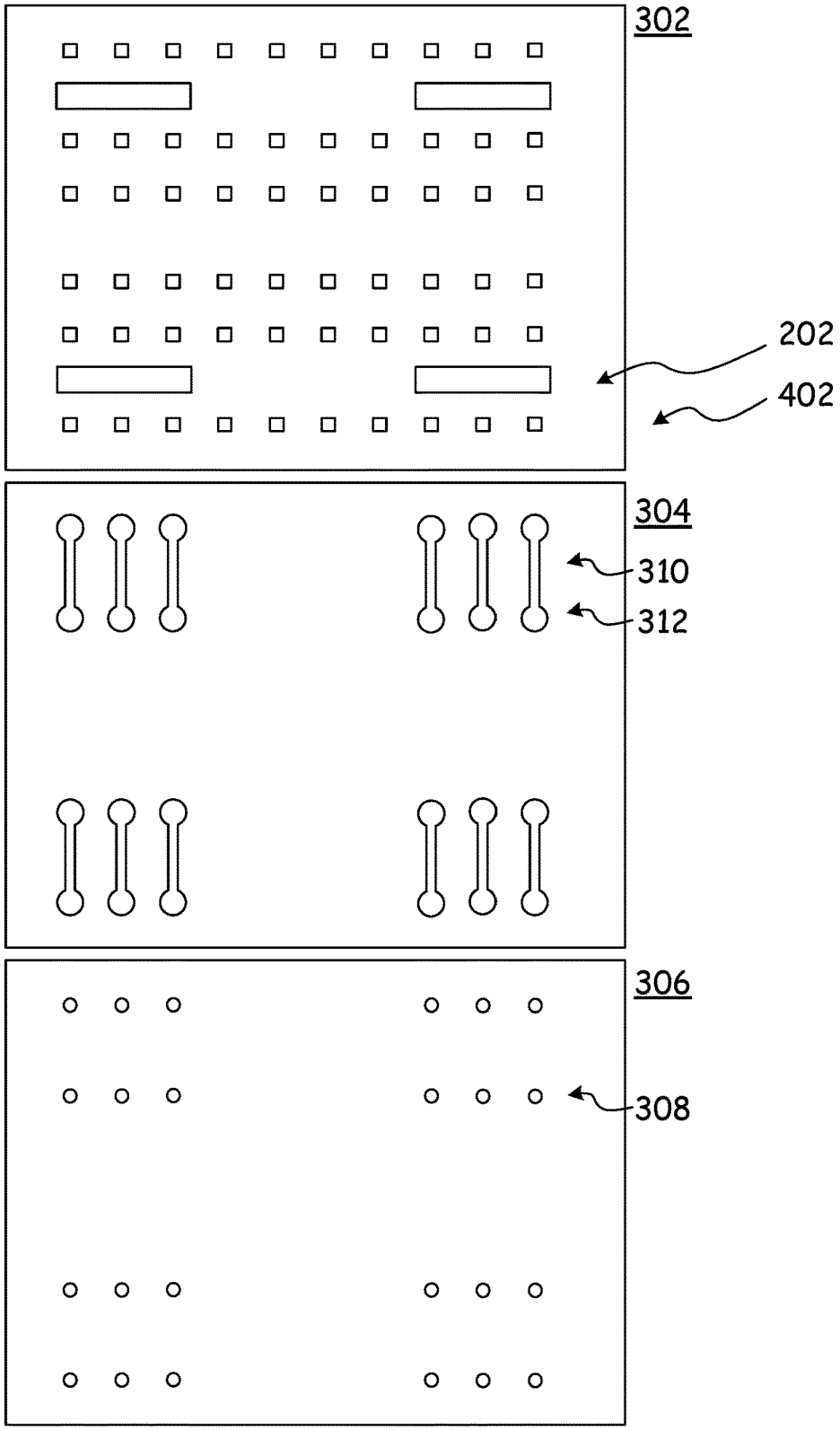
FIG. 8 is plan views of a modified chip, channel layer, and nozzle layer according to a second embodiment of the present invention.

With reference now to FIG. 8, there are depicted plan views of the heater chip 302, channel layer 304, and nozzle plate 306 according to another embodiment of the present invention, where only a subset of the via zones 202 have been cut—just the end portions of the two outside via zones 202, but all of the heaters 402 (and traces 404, not depicted) have been formed through prior processing. Similarly, only the flow channels 310 and bubble chambers 312 in the channel layer 304 that correspond to the formed vias 202 in the heater chip 302 have been formed, and only the nozzles 308 in the nozzle plate 306 that correspond to the formed vias 202 in the heater chip 302 have been formed. This embodiment corresponds to 200*b* in FIG. 2, and can be used when the reservoirs 102 have four outlets (perhaps matching four reservoirs 102).

Figure 9:
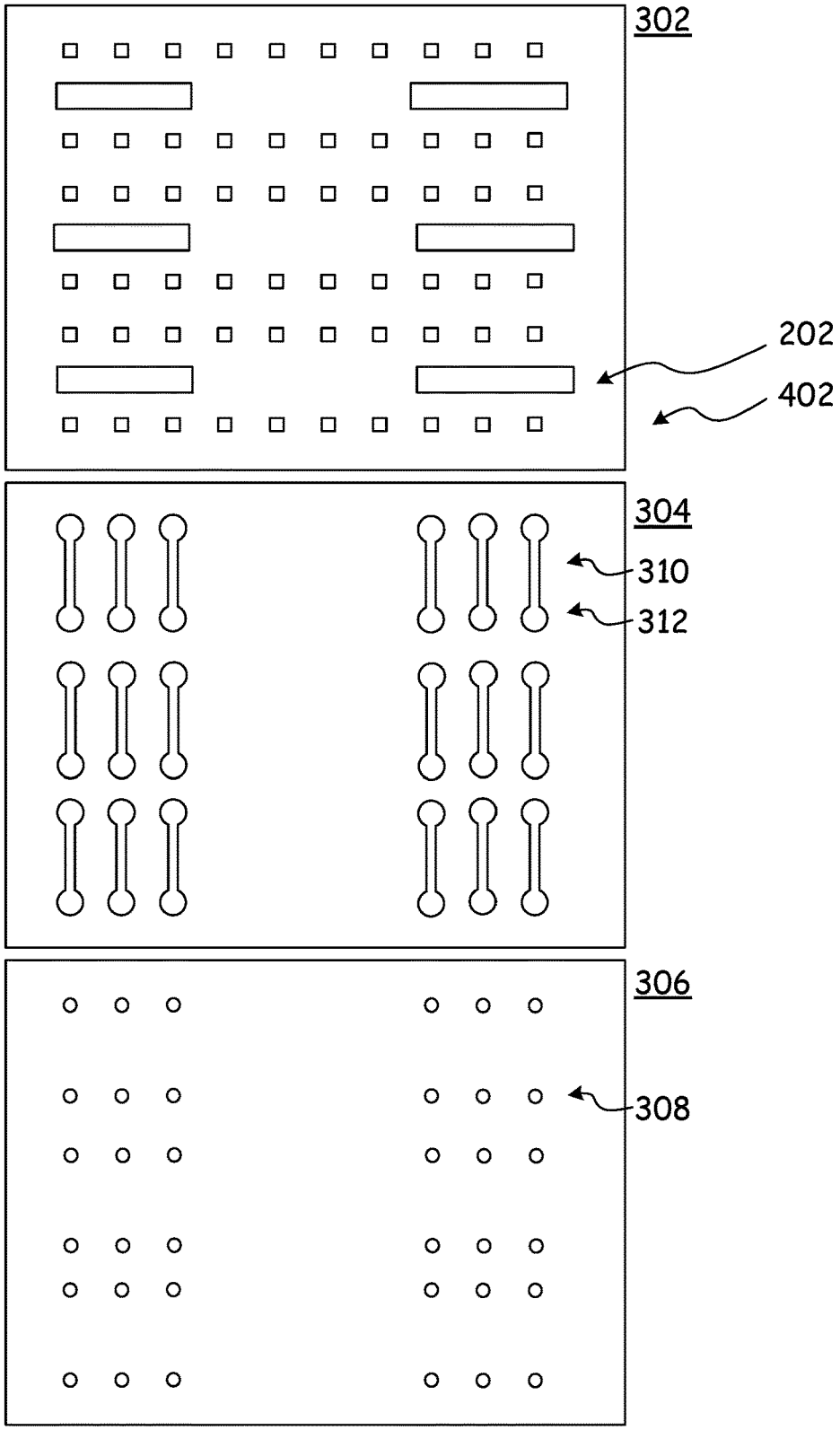
FIG. 9 is plan views of a modified chip, channel layer, and nozzle layer according to a third embodiment of the present invention.

With reference now to FIG. 9, there are depicted plan views of the heater chip 302, channel layer 304, and nozzle plate 306 according to another embodiment of the present invention, where only a subset of the via zones 202 have been cut—just the end portions of all three channels 202, but all of the heaters 402 (and traces 404, not depicted) have been formed through prior processing. Similarly, only the channels 310 and bubble chambers 312 in the channel layer 304 that correspond to the formed vias 202 in the heater chip 302 have been formed, and only the nozzles 308 in the nozzle plate 306 that correspond to the formed vias 202 in the heater chip 302 have been formed. This embodiment corresponds to 200*a* in FIG. 2, and can be used when the reservoirs 102 have six outlets (perhaps matching six reservoirs 102, as depicted in FIG. 1).

Figure 10:
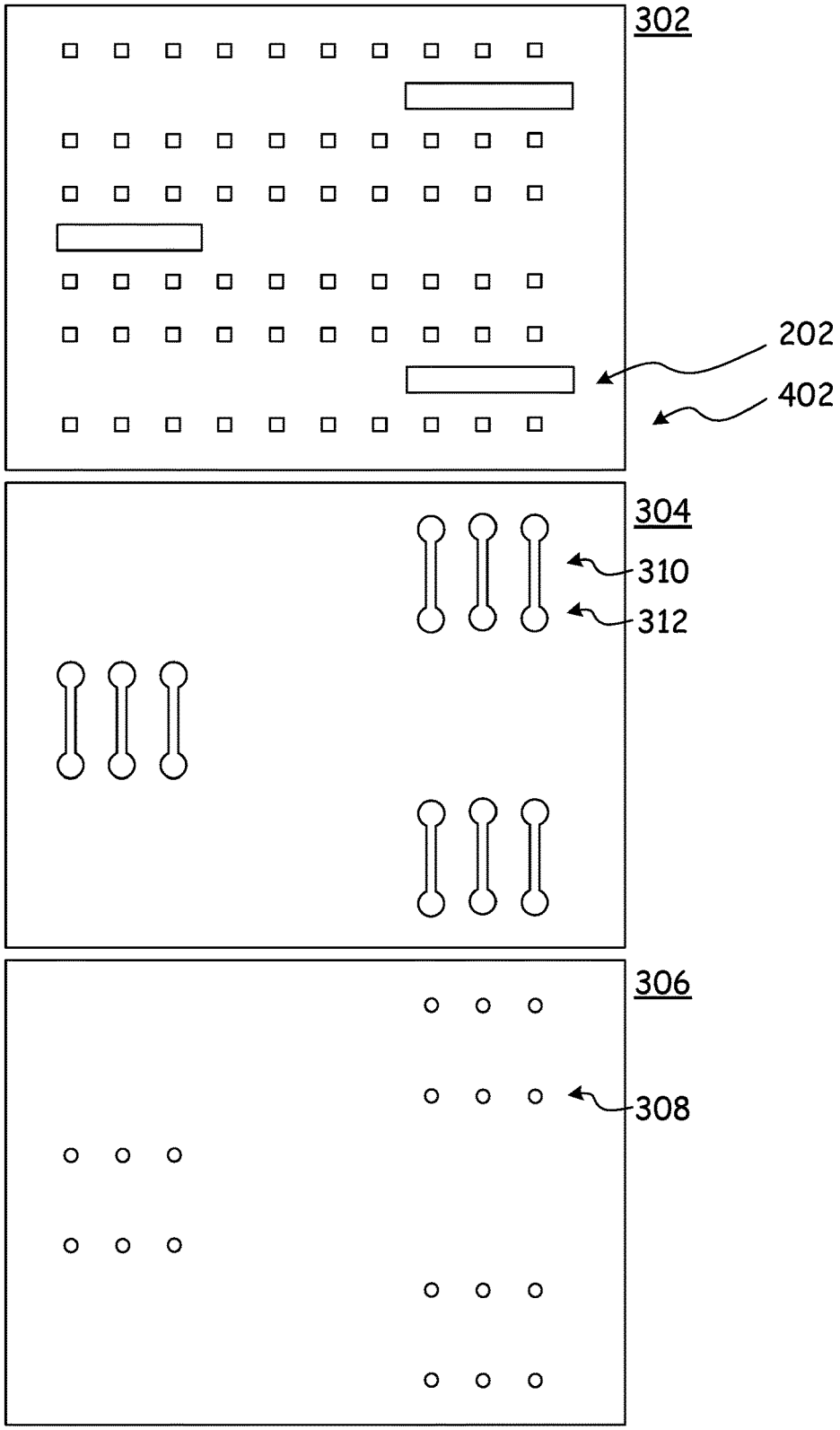
FIG. 10 is plan views of a modified chip, channel layer, and nozzle layer according to a fourth embodiment of the present invention.

With reference now to FIG. 10, there are depicted plan views of the heater chip 302, channel layer 304, and nozzle plate 306 according to another embodiment of the present invention, where only a subset of the via zones 202 have been cut—alternating opposite ends of each of the three channels 202, but all of the heaters 402 (and traces 404, not depicted) have been formed through prior processing. Similarly, only the channels 310 and bubble chambers 312 in the channel layer 304 that correspond to the formed vias 202 in the heater chip 302 have been formed, and only the nozzles 308 in the nozzle plate 306 that correspond to the formed vias 202 in the heater chip 302 have been formed. This embodiment corresponds to 200*e* in FIG. 2, and can be used when the reservoirs 102 have three outlets (perhaps matching three reservoirs 102).

It is appreciated that many other configurations of formed vias 202, flow channels 310, bubble chambers 312, and nozzles 308 are contemplated herein. However, in some embodiments, only those flow channels 310, bubble chambers 312, and nozzles 308 that match the formed vias 202 are formed, while all of the heaters 402 and traces 404 are formed, even though some of them might not be used in all embodiments.

In this manner, heater chips 302 that are completely formed through the creation of the heaters 402 and traces 404 can be fabricated and stocked, and then this stock of adaptable basic heater chips 302 can be drawn upon to form customized print heads 200, thus saving inventory and other costs associated with fabricating completely customized heater chips 302 for every individual application.

In some embodiments, an identifying element is formed in heater chip 302, such as a code stored in a CMOS memory 406, depicted in FIG. 4, to indicate the specific configuration. One embodiment utilizes a simple predetermined list, such as 00 to denote a full utilization of all three vias 202; 01 to denote a two-via design; 10 to denote the four-via quadrant design of 200*b*, and so forth.

In another embodiment, an array of bits defines regions of nozzles 308 that have been formed and are available for use. In the embodiment where three vias 202 are partitioned into three segments, there would be nine total regions available. In this embodiment, for example, full utilization could be encode in the memory with:

1 1 1
1 1 1
1 1 1 indicating all regions of all vias 202 have nozzles 308 available, as depicted by 200*c*. The two-via 202 embodiment of 200*d* would be programmed with:

1 0 1
1 0 1
1 0 1

The four-via 202 segments of 200*b* would be programmed with:

1 0 1
0 0 0
1 0 1

The foregoing description of embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A method of forming a print head, the method comprising the steps of:
- forming a heater chip by,
  - defining via zones having peripheries on a substrate,
  - forming heaters along the entire peripheries of the via zones,
  - forming traces that electrically connect to each of the heaters,
  - optionally, storing the substrate containing the via zones, the heaters, and the traces for later processing, and
  - subsequently, forming vias in only a selected portion of the via zones that comprises a subset of the via zones,
- forming a channel layer on the heater chip by,
  - forming a first layer on the heater chip,
  - forming flow channels in the first layer from the vias to only those heaters on the heater chip that are disposed along the selected portion of the via zones, and
  - forming bubble chambers in the first layer around only those heaters on the heater chip that are disposed along the selected portion of the via zones, and
- forming a nozzle plate on the channel layer by,
  - forming a second layer on the first layer, and
  - forming nozzles in the second layer above only those heaters on the heater chip that are disposed along the selected portion of the via zones.

2. The method of claim 1, wherein the substrate comprises a silicon substrate.

3. The method of claim 1, wherein the heaters and traces comprise a deposited metal.

4. The method of claim 1, further comprising a memory circuit formed in the heater chip, the memory circuit containing information in regard to a configuration of the selected portion.

5. The method of claim 1, wherein there are three via zones.

6. The method of claim 1, wherein there are three via zones and only two of the via zones are the selected portion.

7. The method of claim 1, wherein there are three via zones and only end portions of the via zones are the selected portion.

8. The method of claim 1, wherein there are three via zones and only end portions of two of the via zones are the selected portion.

9. The method of claim 1, wherein there are three via zones and only alternating end portions of the via zones are the selected portion.

10. A method of forming a print head, the method comprising the steps of:

forming a heater chip by, defining via zones having peripheries on a substrate, forming heaters along the entire peripheries of the via zones, forming traces that electrically connect to each of the heaters, storing the heater chip for a period of time, after storing the heater chip, forming vias in only a selected portion of the via zones that comprises a subset of the via zones, forming a channel layer on the heater chip by, forming a first layer on the heater chip, forming flow channels in the first layer from the vias to only those heaters on the heater chip that are disposed along the selected portion of the via zones, and forming bubble chambers in the first layer around only those heaters on the heater chip that are disposed along the selected portion of the via zones, and forming a nozzle plate on the channel layer by, forming a second layer on the first layer, and forming nozzles in the second layer above only those heaters on the heater chip that are disposed along the selected portion of the via zones.

11. The method of claim 10, wherein the substrate comprises a silicon substrate.

12. The method of claim 10, wherein the heaters and traces comprise a deposited metal.

13. The method of claim 10, further comprising a memory circuit formed in the heater chip, the memory circuit containing information in regard to a configuration of the selected portion.

14. The method of claim 10, wherein there are three via zones.

15. The method of claim 10, wherein there are three via zones and only two of the via zones are the selected portion.

16. The method of claim 10, wherein there are three via zones and only end portions of the via zones are the selected portion.

17. The method of claim 10, wherein there are three via zones and only end portions of two of the via zones are the selected portion.

18. The method of claim 10, wherein there are three via zones and only alternating end portions of the via zones are the selected portion.

19. A method of forming a print head, the method comprising the steps of:

forming a heater chip by, defining via zones having peripheries on a silicon substrate, forming heaters along the entire peripheries of the via zones, forming traces that electrically connect to each of the heaters, storing the heater chip for a period of time, after storing the heater chip, forming vias in only a selected portion of the via zones that comprises a subset of the via zones, forming a channel layer on the heater chip by, forming a first layer on the heater chip, forming flow channels in the first layer from the vias to only those heaters on the heater chip that are disposed along the selected portion of the via zones, and forming bubble chambers in the first layer around only those heaters on the heater chip that are disposed along the selected portion of the via zones, and forming a second layer on the first layer, and forming nozzles in the second layer above only those heaters on the heater chip that are disposed along the selected portion of the via zones.

20. The method of claim 19, wherein the heaters and traces comprise a deposited metal.

* * * * *